US009297138B2

(12) United States Patent
Stenger

(10) Patent No.: US 9,297,138 B2
(45) Date of Patent: Mar. 29, 2016

(54) TRENCH BOX WITH PLANE WALLS

(71) Applicant: STENGER ApS, Branderup J (DK)

(72) Inventor: Preben Stenger, Branderup J (DK)

(73) Assignee: STENGER APS, Branderup J (DK)

( * ) Notice: Subject to any disclaimer, the term of this patent is extended or adjusted under 35 U.S.C. 154(b) by 0 days.

(21) Appl. No.: 14/375,012

(22) PCT Filed: Jan. 30, 2013

(86) PCT No.: PCT/DK2013/050028
§ 371 (c)(1),
(2) Date: Jul. 28, 2014

(87) PCT Pub. No.: WO2013/113318
PCT Pub. Date: Aug. 8, 2013

(65) Prior Publication Data

US 2015/0010367 A1 Jan. 8, 2015

(30) Foreign Application Priority Data

Jan. 30, 2012 (DK) ..... 2012 70050

(51) Int. Cl.
*E02D 17/08* (2006.01)

(52) U.S. Cl.
CPC ..... *E02D 17/08* (2013.01)

(58) Field of Classification Search
CPC ..... E02D 17/08; E02D 17/083
USPC ..... 405/272, 273, 282, 283
See application file for complete search history.

(56) References Cited

U.S. PATENT DOCUMENTS

| | | | | |
|---|---|---|---|---|
| 3,992,887 A | | 11/1976 | Fischer | |
| 4,019,330 A | * | 4/1977 | Griswold | 405/283 |
| 4,259,028 A | | 3/1981 | Cook | |
| 4,685,837 A | * | 8/1987 | Cicanese | 405/282 |
| 4,752,157 A | * | 6/1988 | Ischebeck et al. | 405/282 |
| 5,277,522 A | * | 1/1994 | Pertz | 405/283 |

(Continued)

FOREIGN PATENT DOCUMENTS

EP 2006453 A2 6/2008

OTHER PUBLICATIONS

EPO, International Search Report for International Application No. PCT/DK2013/050028, completed Dec. 12, 2013, (total 3 pgs.).

(Continued)

*Primary Examiner* — Benjamin Fiorello
(74) *Attorney, Agent, or Firm* — Barclay Damon, LLP

(57) ABSTRACT

The present invention relates to both a trench box, the use of a trench box and the method for using said trench box. When assembled, said trench box comprises at least two oppositely placed side walls, each side wall having a thickness, a length and a height, an outer wall area and an inner wall area, said trench box further comprising a number of distance struts. Said distance struts are arranged to be secured between said oppositely placed side walls. A trench box according to the invention is new in that a side wall comprises at least a frame part with a first thickness, a length and a height being substantially the same as the length and height of the side wall, said side wall further comprising a center part placed inside the frame part, said center part having a second thickness and comprising one or more strengthening elements, and said side wall further comprising a cover on the outer area of the side wall. Said cover comprises at least one plate, wherein the at least one plate is substantially plane and without corrugations.

20 Claims, 7 Drawing Sheets

(56) References Cited

U.S. PATENT DOCUMENTS

| | | | | |
|---|---|---|---|---|
| 5,302,054 | A | 4/1994 | Winkler et al. | |
| 5,305,568 | A * | 4/1994 | Beckerman | 52/309.4 |
| 5,720,580 | A * | 2/1998 | Ryhsen | 405/282 |
| 7,258,511 | B1 * | 8/2007 | Cerda et al. | 405/282 |

OTHER PUBLICATIONS

EPO (ISA/EP) Written Opinion of the International Searching Authority for International Application No. PCT/DK2013/050028, completed Dec. 12, 2013 (total pages).

* cited by examiner

TRENCH BOX WITH PLANE WALLS

CROSS REFERENCE TO RELATED APPLICATIONS

This application is a national stage application pursuant to 35 U.S.C. §371 of International Application No. PCT/DK2013/050028, filed Jan. 30, 2013, which claims priority to, and the benefit of, Danish Patent Application No. PA 2012 70050, filed on Jan. 30, 2012. The entire contents of such applications are hereby incorporated herein by reference.

TECHNICAL FIELD

The present invention relates to a trench box, use of a trench box as well as a method for use of such a trench box, said trench box comprising at least two oppositely placed side walls, when it is assembled, each side wall having a thickness, a length and a height, an outer wall area and an inner wall area, said trench box further comprising a number of distance struts, said distance struts being arranged to be secured between said oppositely placed side walls.

BACKGROUND OF THE INVENTION

In connection with various large trenches, e.g. in connection with sewerage types of work or other work at the bottom of trench, it is commonly known to use so-called trench boxes. Typically, a trench box comprises two oppositely placed side walls kept at a certain distance by a number of distance struts, said trench box being arranged to prevent cave-ins on top of a person working in the trench. After digging a trench, such trench boxes are assembled and lowered, typically by means of a crane or a digger. In connection with trenches having a depth of more than 1.7 meters, it is a legal requirement in many countries to use trench boxes, whereas in less deep trenches, there are no specific requirements concerning the use of trench boxes. Common trench boxes are often large, i.e. having a height and length of more than 1.7 meters, and they are often made of steel making them heavy and completely impossible to handle without mechanical lifting equipment. Furthermore, many sewer contractors do not have access to such trench boxes. Instead, they rent the compulsory trench boxes when digging large and deep trenches. In particular, the fact that trench boxes are often an item you have to rent a couple of days prior to use means that work in trenches requiring shoring up is sometimes conducted without shoring up. The fact that people have been injured and even died in cave-ins of trenches lacking shoring up clearly proves that a solution is required which is more simple and thus easier to mount and use than the known heavy and large trench boxes.

In connection with trenches not being very deep, there is sometimes a need for and a wish to shore the walls, but since the large trench boxes are as large and heavy as they are, work is often carried out without shoring up. Alternatively, a more primitive shoring up by wooden boards and timber is used. However, such a primitive but time-consuming shoring up is often only used in trenches expected to be open for a long period. Especially when carrying out trenches in soil having been excavated previously, there is an increased risk of cave-ins of the trench. Therefore, the persons working in trenches lacking shoring up are exposed to a certain risk of injury.

Therefore, there is a great need for an appropriate and relatively light and manageable type of trench box which is especially suitable for use in trenches not being very deep, in which there is a need or wish for shoring up of the sides of the trench for various reasons.

ASPECT OF THE INVENTION

The aspect of the invention is to provide a trench box especially suitable for use in trenches with a relatively small depth, typically in connection with sewerage work at single-family houses or the like using manual labour and with small excavators.

DISCLOSURE OF THE INVENTION

As mentioned above, the invention relates to a trench box, use of a trench box as well as a method for use of such a trench box, said trench box comprising at least two oppositely placed side walls, when it is assembled, each side wall having a thickness, a length and a height, an outer wall area and an inner wall area, said trench box further comprising a number of distance struts, said distance struts being arranged to be secured between said oppositely placed side walls. As mentioned above, such trench boxes are known, but the known types comprise certain unsuitable features, where especially the weight, but also other features complicate the use of such trench boxes.

The new aspect of a trench box according to the invention is that a side wall comprises at least a frame part with a first thickness, a length and a height being substantially the same as the length and height of the side wall, said side wall further comprising a centre part placed inside the frame part, said centre part having a second thickness and comprising one or more strengthening elements, and said side wall further comprising a cover on the outer area of the side wall, said cover comprising at least one plate, wherein the at least one plate is substantially plane and without corrugations.

A much lighter construction than the known trench boxes is achieved by arranging a side wall for a trench box with a frame part comprising a centre part, and where an outer cover in form of a plate is secured on said frame part. Here, the cover, which is mounted on the outer side of the side wall thereby being in contact with the walls of the trench, is made of an even and relatively smooth plate material thus ensuring especially easy removal of the trench box as there is no locking between sand/soil on the outer side and the actual cover of the trench box. In particular, such locking has been a problem of previously known types of trench boxes as the outer areas have had corrugations or other unevenness being filled with sand/soil thus requiring increased effort in connection with removal.

Thereby, the outer side area of a trench box side wall according to the invention completely lacks parts projecting from the surface. Consequently, there are no parts locking sand/soil to the plate surface, and there is also very low friction between the plate and the sand/soil in the trench.

A preferred cover for a trench box according to the invention is a plastic plate, e.g. a plastic plate made of recycled plastic, preferably having a thickness of about 10 mm. Such a plastic plate may be mounted on the side wall and secured along the edges of the frame part and e.g. also on the centre part. Preferably, such securing is carried out by means of blank rivets, but may also be by means of bolts, e.g. carriage bolts or other types of bolts or screws with a flat head.

By using smooth plastic plates on the outer side area of a side wall for a trench box, the obvious advantage is achieved that a trench box does not adhere to sand/soil, thereby making it easier to remove it from a trench, but also that the weight of the trench box is kept lower, which is of especially great importance when handling an assembled trench box but also when handling each side wall during mounting before use and during dismounting after use.

By keeping the weight low, e.g. below 450 kg or even lower for a trench box having the size of e.g. 200×250 cm, it is possible to handle the trench box and its separate parts by using a so-called mini digger. Especially, the ability to lift and handle a trench box with a traditional mini digger is of great importance as such machine is normally always on site and being used for small trenches in connection with sewage work and similar jobs at holiday homes, terraced houses and/or single-family houses. A trench box according to the invention renders it possible with the common tools and machines to work safely in a trench without having to use a big crane or digger when lowering or removing a trench box. A big crane or digger is often cut, thereby risking the safety of the individual worker.

In a preferred embodiment of a trench box according to the invention, that the frame part having a first thickness and the centre part having a second thickness may be arranged in such a relation to each other that the two parts are substantially level with each other at one side of said side wall. Thereby, it is possible to mount one single and substantially even plate cover and abutting both the centre part and the frame part. Typically, this will be at the outer side of the side wall, whereby the above-mentioned advantages of removal of the trench box are achieved.

In a preferred embodiment of a trench box according to the invention, at least the frame part may be made of tube elements with a closed cross section, e.g. square pipes made of aluminium or steel. Furthermore, the centre part may also be made of tube elements with a closed cross section. The frame comprises four profiles joined so as to form a square. In a preferred embodiment, the frame may be a rectangle.

It is, however, clear that a frame part as well as a centre part may be made of e.g. U-shaped profiles which would, however, cause certain inconveniences such as sand and soil gathering in the open profiles.

In a special embodiment of a trench box according to the invention, the frame part has a thickness extending in the direction of thickness of the side wall, said thickness being larger than the thickness of the centre part and this thickness also extending in the direction of thickness of the side wall. Thereby, it is possible to have a very stiff and strong frame, while the centre part is made in a smaller dimension, but with an adequate stiffness and strength for keeping sand and soil from the trench in place, in case the sides should cave-in. In this way, an especially stiff frame part is achieved, said frame part being suitable for mounting of e.g. distance struts and lifting eyes. Said distance struts and lifting eyes must be mounted in parts being able to carry the weight when the trench box is moved and transported.

Advantageously, the frame part may be made of a tube element with a square cross section and may be made of steel or aluminium. The centre part is mounted inside the frame part. Advantageously, said centre part may also be made of a tube element with a closed and square cross section which is commonly known in relation to tube elements.

In an especially advantageous embodiment of a trench box according to the invention, a cover may also be arranged at the inner area of the side wall on the centre part (8) and at a distance from the periphery of the frame part, said cover comprising at least one plate. By mounting a plate also at the inner side of the side wall, the advantage is achieved that the user working in the trench box avoids bumping hands and elbows against the shoring elements in the centre part. Increased comfort is so to speak achieved during trench work. Advantageously, the inner cover may also be made by a plastic plate which may e.g. require a smaller thickness than the outer cover plate as the inner plate does not have to withstand any pressure from sand/soil. Such an inner cover may e.g. have a thickness of approx. 5 mm and also, said cover may advantageously be secured to the centre part by means of blank rivets or appropriate screws with a flat head. In an embodiment, the side wall may be made in HD-PE plastic. SD612BSLF-15.9 pop rivets may be used for mounting of the side walls.

By mounting the inner cover at a distance from the periphery of the frame part, it is ensured that there is free access to the frame part specifically to which the above distance struts are to be secured. Also, it is an advantage if the centre part comprises at least one strengthening element along each side of the frame part that said strengthening elements in the centre part are mounted at a certain distance, e.g. 10 cm, in relation to the inner side of the frame part. Thereby, no "pockets" are formed in the side wall, wherein sand and soil may enter and increase the weight of the side walls of the trench box. As mentioned, free access to the frame part is achieved at the same time, thereby making mounting of the distance struts easy.

In an embodiment, the inner side walls may extend all the way to the frame part. However, in such an embodiment, the side wall must leave sufficient room for the distance struts to be mounted. This may be taken into account by placing the holes for mounting of the distance struts at a suitable distance from the side wall. The inner side wall may be shaped with a blind-hole, with the outside wall constituting the bottom. Thereby, it is avoided that soil or the like gathers in the gap between the inner and the outer side wall.

By using side walls as described herein, no parts protrude which would hinder handling or storing. The frame part constitutes the outermost periphery on a side part and at one side of the side part, the cover is placed outermost, while the inner side of the frame part constitutes the outermost elements of the other side. Thereby, it is possibly to place side parts directly side by side or on top of each other during storing and/or transportation.

The invention comprises a further embodiment of a trench box, in which the frame part comprises a number of through-holes for securing a bracket part on a distance strut, preferably a distance strut with an adjustable length and with a fork-shaped bracket at each end. By having said through-holes in the frame part, a simple and sturdy joint between distance struts and side parts is achieved. In a preferred embodiment of the invention, said through-holes are placed with a distance of 50-85 cm from the bottom of the side wall and approx. 10-25 cm from the top of a side wall. Thereby, the possibility of optimal support is achieved, and at the same time it is possible to work below the lowest distance struts on an exposed or recently laid sewer or the like without any contact between the trench box and the sewer pipe. It is, however, obvious that the through-holes may be placed in a different manner than mentioned herein, and it is also obvious that a side wall for a trench box according to the invention may comprise numerous through-holes so that the placement of the distance struts may be chosen exactly for the specific job. In an embodiment, one set of the bores and thereby one set of the distance struts may be placed 85 cm from the frame part, thus ensuring a work height of 80 cm below the mandrels. This provides the trench box with a resistance force of 20 kN/m$^2$ when the part is made of 80×60×3 mm steel pipe S235, and the centre part is made of 40×40×3 steel pipe, also of the quality S235.

In an embodiment, the frame of the trench box may measure 200 cm×250 cm. With this dimension, the trench box weighs approx. 450 kg with distance struts/distance pieces, and each side wall, a side panel, weighing approx. 212 kg. This enables moving of the walls and trench box by using a mini digger.

In a second embodiment, the trench box may measure 200 cm×150 cm. With this dimension, the trench box weighs 255 kg and each side panel/side wall weighs approx. 110 kg.

In a third embodiment, the trench box may measure 350 cm×200 cm. In this embodiment, the trench box weighs approx. 670 kg. Thus, it is still possible to handle such a trench box according to the invention with a relatively small machine.

Thus, it is possible that a trench box according to the invention may be arranged so that a number of through holes for securing a bracket part on a distance strut are arranged at all the edges of the frame part, both length and width-wise. As it is thereby possible to move the distance struts, it is possible to use the trench box both with the longitudinal side facing the bottom of the trench as well as the width side facing the trench bottom. Thereby, it is rendered possible for the trench box to be used for trenches with different heights of the walls of the trench, i.e. a different depth of the trench. It is an advantage that the distance struts may be moved as it renders a stronger and better work space possible for the people or tools working in or at the trench box.

To prevent sand and/or soil from entering the tube elements constituting the frame part, the through-holes in the frame part for securing a bracket at one end of a distance strut may be made with a through-going tube part extending all the way through the tube elements of the frame part, said tube elements having closed cross section. This can be seen in detail in one of the below figures.

Advantageously, the above-mentioned distance struts may be secured on the frame part on the side wall by means of a manually operated bolt, said bolt comprising fastening means. Said fastening means may be a hairpin split, a split pin or another suitable split. However, it may also be fastening means which are built into the bolt and place themselves across when the bolt is in position thus preventing the bolt from falling out. Such fastening means may be spring-loaded or may be arranged so as to be affected by gravitation.

In an especially advantageous embodiment, the side walls are rectangular. Thereby, it is achieved that the side walls and thus the entire trench box may be turned so that a high but not so long trench box is achieved in the first orientation, and in the second orientation, a long and not so high trench box is achieved.

The invention also comprises use of a trench box as described above, where the trench box is used in trenches having a depth of up to approx. 250 cm, said use typically taking place in connection with sewage work at holiday homes, terrace houses and single-family houses. Especially under such circumstances, problems with known heavy trench boxes often occur as said heavy trench boxes can only be handled by heavy machinery that is often not on site. By using a trench box as claimed, it may be handled by an ordinary mini digger or alternatively an excavator which are machine types actually always used for even the smallest, although still potentially dangerous, trenches. With the invention, it is thereby possible to place a trench box without a person being present in the trench at any time, neither during placement nor working with or removal of the trench box. Thereby, it is a task that may be performed by only one person, thus increasing safety as this person works alone and primarily as operator of the mini digger or excavator.

Furthermore, the invention comprises a method for use of a trench box as described, said method comprising at least the following steps:

- mounting of distance struts between two side walls,
- lowering of the trench box into a trench by means of a mini digger or an excavator,
- possible adjustment of the length of the distance struts,
- execution of the necessary work in the trench,
- removal of the trench box from the trench by means of a mini digger or an excavator,
- separation of side walls and distance struts.

Thus, it is possible by means of the invention to store, mount, use, separate and/or transport a trench box that may be used without special requirements for transportation or crane equipment as an ordinary mini digger may be used for the necessary lifts, while transport may be conducted on an ordinary mini truck or on the type of trailer usually and often used by contractors.

DESCRIPTION OF THE DRAWINGS

The invention is explained below with reference to the drawings, in which.

In the description of the figures, identical or similar elements will be described using the same reference numbers in the various figures. Thereby, an explanation of all details in relation to each individual figure/embodiment will not be given.

LIST OF REFERENCES

Figure 1:
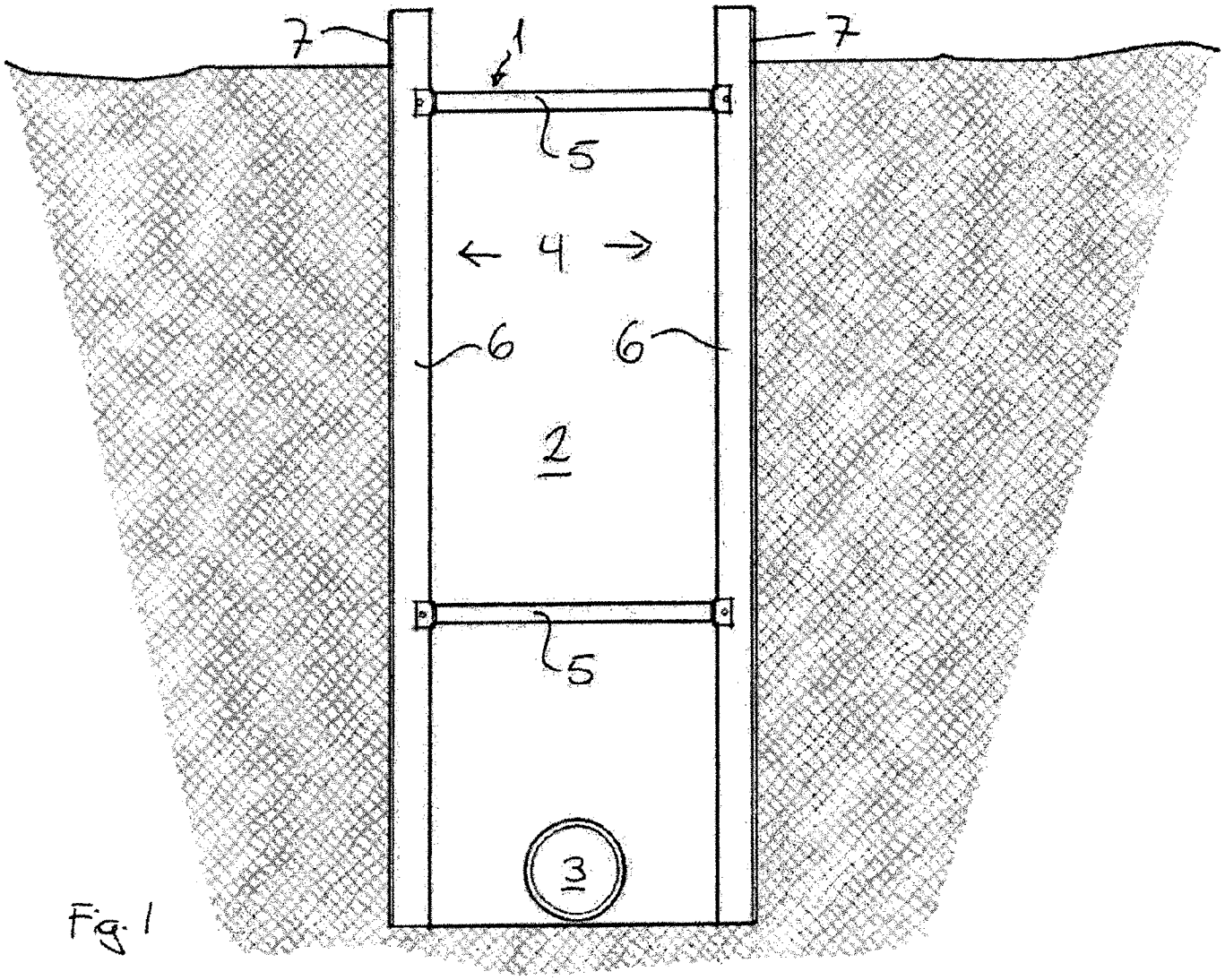
FIG. 1 shows a trench box in a trench, in which a sewer pipe is shown at the bottom.

1 Trench box
2 Trench
3 Sewer line
4 Side wall
5 Distance strut/distance piece
6 Frame part
7 Outer cover
8 Centre part
9 Inner cover
10 Through-holes in frame part
11 Tube part in through-hole in frame part
12 Bolt
13 Fork-shaped bracket on distance strut
14 Fastening means
15 Pawl on bolt
20 Lifting eye
A1 First axis
A2 Second axis

DETAILED DESCRIPTION OF THE INVENTION

FIG. 1 shows a trench box 1 in a trench 2, in which a sewer line 3 is shown at the bottom. The trench box 1 comprises two oppositely placed side walls 4 kept apart by a number of distance struts/distance pieces 5 being secured on the frame part 6 on the respective side walls 4. An outer cover 7, here being made of a plastic plate having a thickness of approx. 10 mm, is shown outermost on each side wall 4. However, said cover 7 may be made of another material, e.g. plywood and/or have a different thickness. In the shown figure, the side walls 4 are placed close to the sides of the trench which is optimal and may be achieved by adjusting the length of the distance struts. Therefore, a distance strut 5 may be arranged with adjustment means, not shown, typically comprising two threaded rods and a body in the same way as in known from e.g. a rigging screw and a top link.

Figure 2:
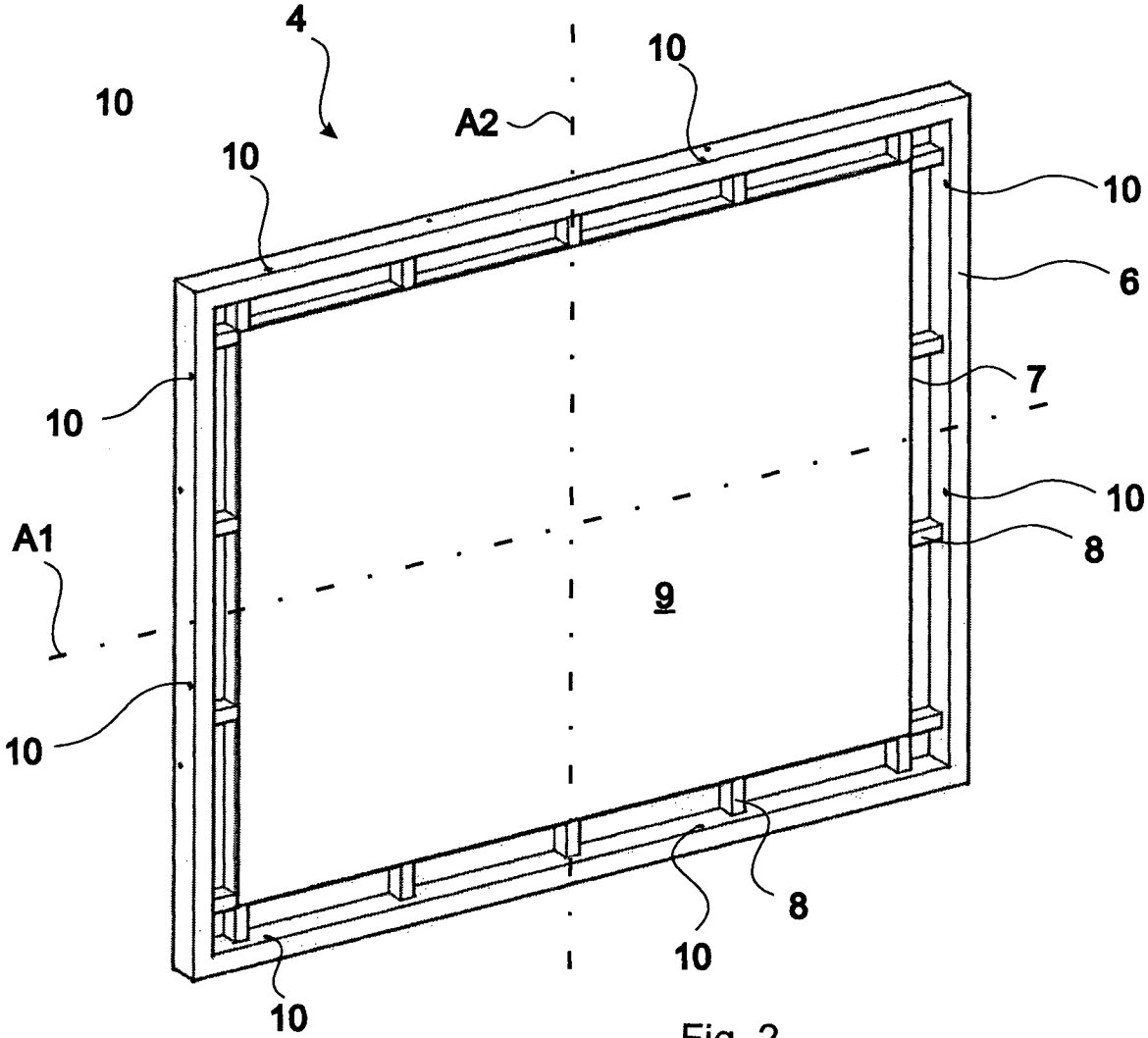
FIG. 2 shows a side wall for a trench box.

FIG. 2 shows a side wall 4 for a trench box 1, wherein a closed square tube element constitutes the frame part 6. Inside the frame part 6, a centre part 8 is shown, said centre part 8 here being made of a closed square tube element like the frame part 6, but with a smaller dimension. The centre part 8 is shown and described more clearly in FIG. 7. Externally, the centre part 8 and the frame part 6 are levelled, and here an outer cover 7 is mounted, where the rear side of said cover 7 shows through the centre part 8. On the inner side of the side wall 4 and on the outside of the centre part 8, the inner cover 9 is shown. As shown in the figure, the centre part 8 is made of five vertical profiles, i.e. profiles being parallel with the axis A2, and of four horizontal profiles, i.e. profiles being parallel with the axis A1, all profiles extending parallel with the vertical and horizontal profiles of the frame part 6, respectively. Due to the inner side wall 9, it is only possible in this figure to see a relatively small part of each of the profiles of the centre part 8 in this figure (thus, see FIG. 7). Furthermore, it is shown that the outermost profiles in the centre part are only just covered by the inner cover 9, so that there is free access to the through-holes 10 in the frame part 6. At the same time, there is no access to the gap created by the two covers 7, 9 and the centre part 8 itself. Thereby, sand and soil are prevented from entering in between the two covers 7, 9, which would otherwise increase the weight of a side wall significantly. As is also shown in the figure, two through-holes 10 are placed at each side of the frame part, thus making it possible to use a trench box according to the invention both on the one side, where the axis A1 is substantially parallel with the bottom of the trench, and on the other side, where the axis A2 is substantially parallel with the bottom of the trench.

Figure 3:
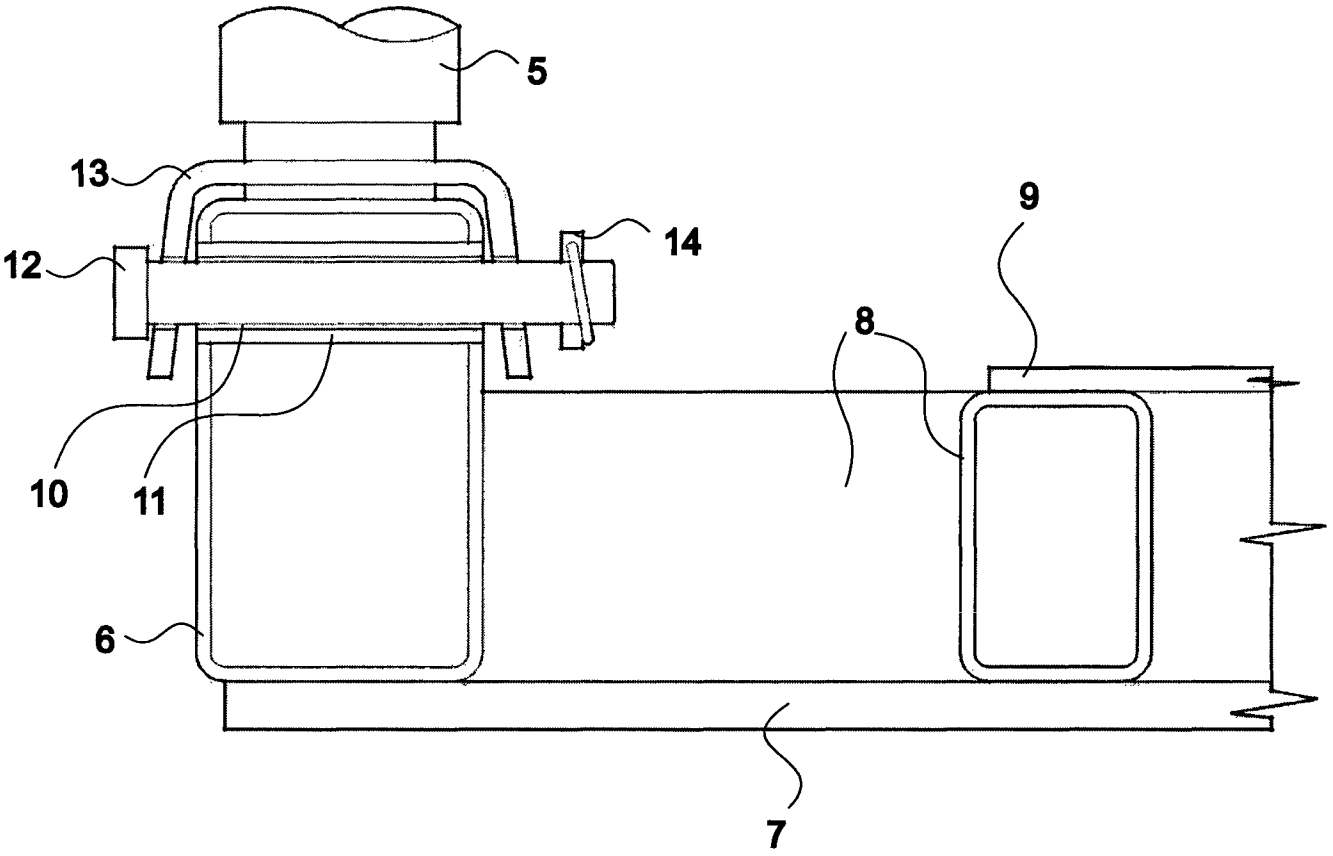
FIG. 3 shows a detailed cross-sectional view with a frame part and a distance strut.

FIG. 3 shows a cross-sectional view of a part of a frame part 6 and a distance strut 5. Here, the frame part 6 is shown with a through-hole 10, said hole being made of a tube part 11 being mounted through the frame part 6. Thereby, the advantage is achieved that no sand, soil or water will enter the frame part 6, and that it is much easier to mount the bolt 12 as it is not necessary to search for the hole at the other side of the frame part 6. At the end of the distance strut 5, a fork-shaped bracket 13 is placed which corresponds to the through-holes 10 and through which a bolt 12 may be mounted to achieve a safe securement of the distance strut 5 to the frame part 6. Fastening means 14 are shown in the bolt 12. Here, they are shown as a split pin, but they may easily be made of another suitable type, of split or mechanism. It is shown that the outer wall 7 is abutting both one area of the frame part 6 and one side of the centre part 8 in a substantially plane way.

Figure 4:
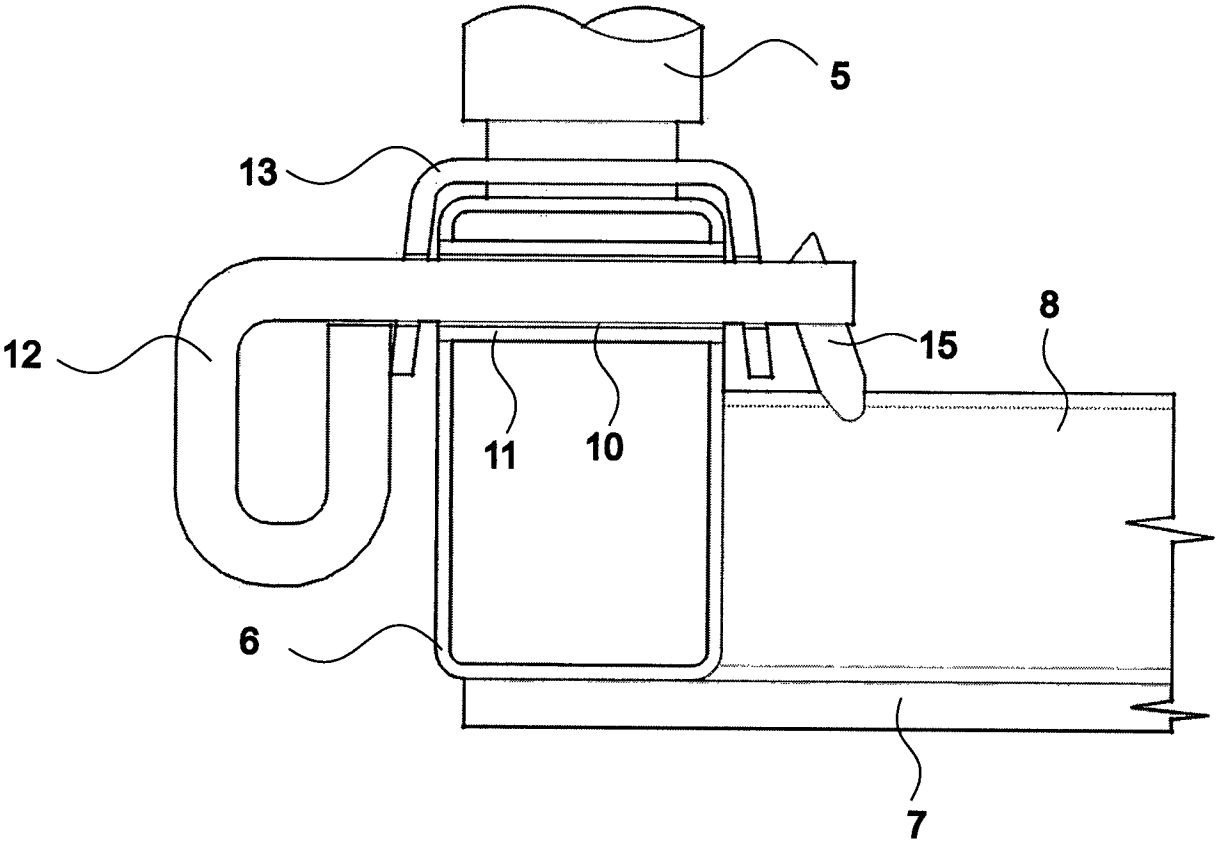
FIG. 4 shows a type of fastening means at a distance strut.

FIG. 4 shows an embodiment of the invention using another type of fastening means 14. Here it relates to a bolt 12 with built-in fastening means 14 functioning in that the pawl 15 on the bolt 12 places itself across the through-hole 10 and the hole on the fork-shaped bracket 13, when the bolt 12 is in place.

Figure 5:
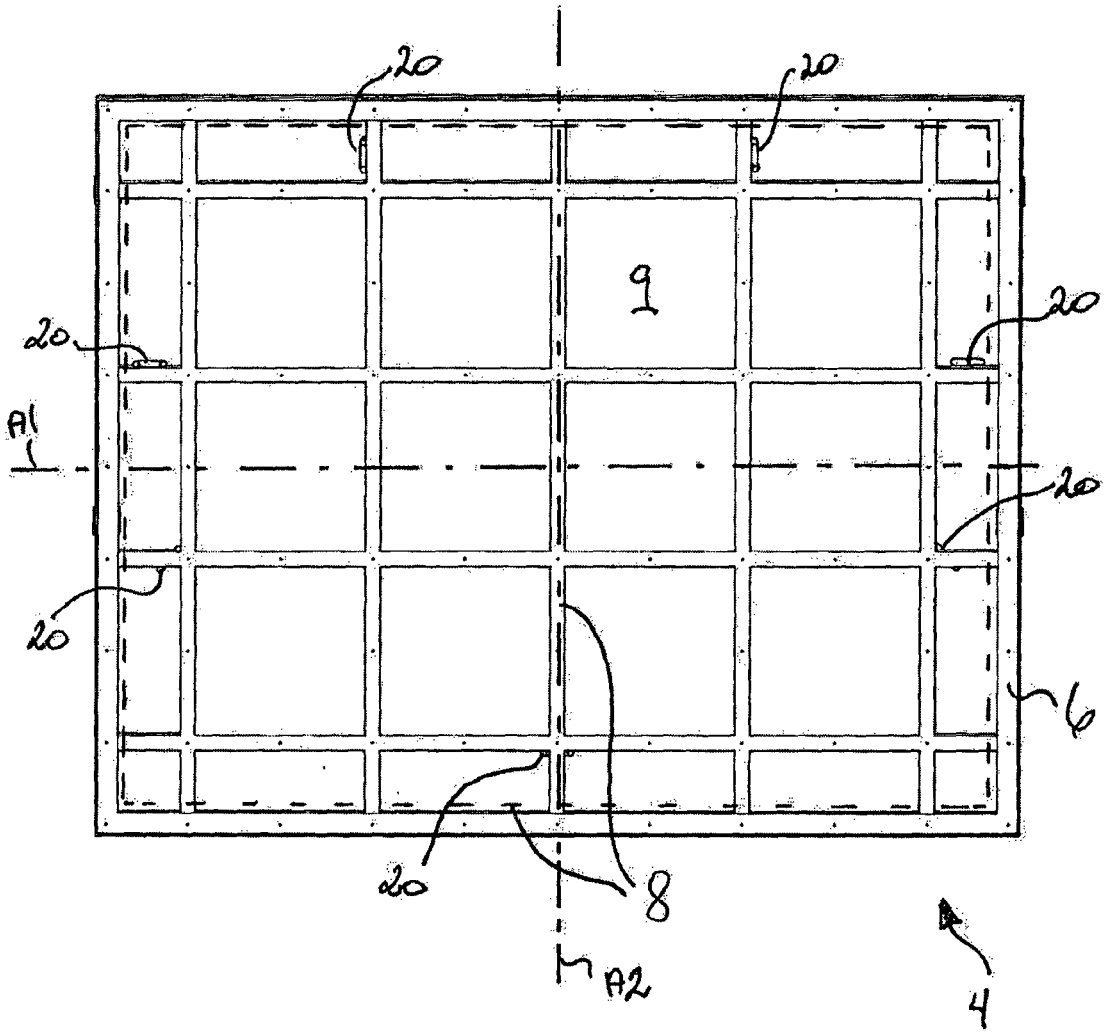
FIG. 5 shows a side wall without outer and inner cover, respectively.

FIG. 5 shows a side wall 4, where the outer cover is removed. Thereby, the structure of the centre part 8 behind said covers is shown. To visualise the centre part 8, said part is marked by a dotted line. It is to be understood that the centre part 8 extends between the sides of the frame part 6. Thereby, the centre part 8 comprises a type of truss structure supporting the covers 7, 9 of the side wall. This structure provides the side wall with both tensile and compressive strength. A person skilled in the art will understand that other types of supportive structures may be used. Furthermore, it is shown that a number of lifting eyes 20 are mounted (these will be shown in more detail in a subsequent figure). The number of lifting eyes 20 may both decrease and increase as the side wall may be turned. With reference to FIG. 2, the side wall (the entire trench box) may be turned with either the axis A1 being substantially parallel with the bottom of the trench or the axis A2 being substantially parallel with the bottom of the trench. The lifting eyes 20 are placed in such a way that one side of the side wall 4 is maintained level so that the outer cover 7 (not shown) can be mounted easily.

Figure 6:
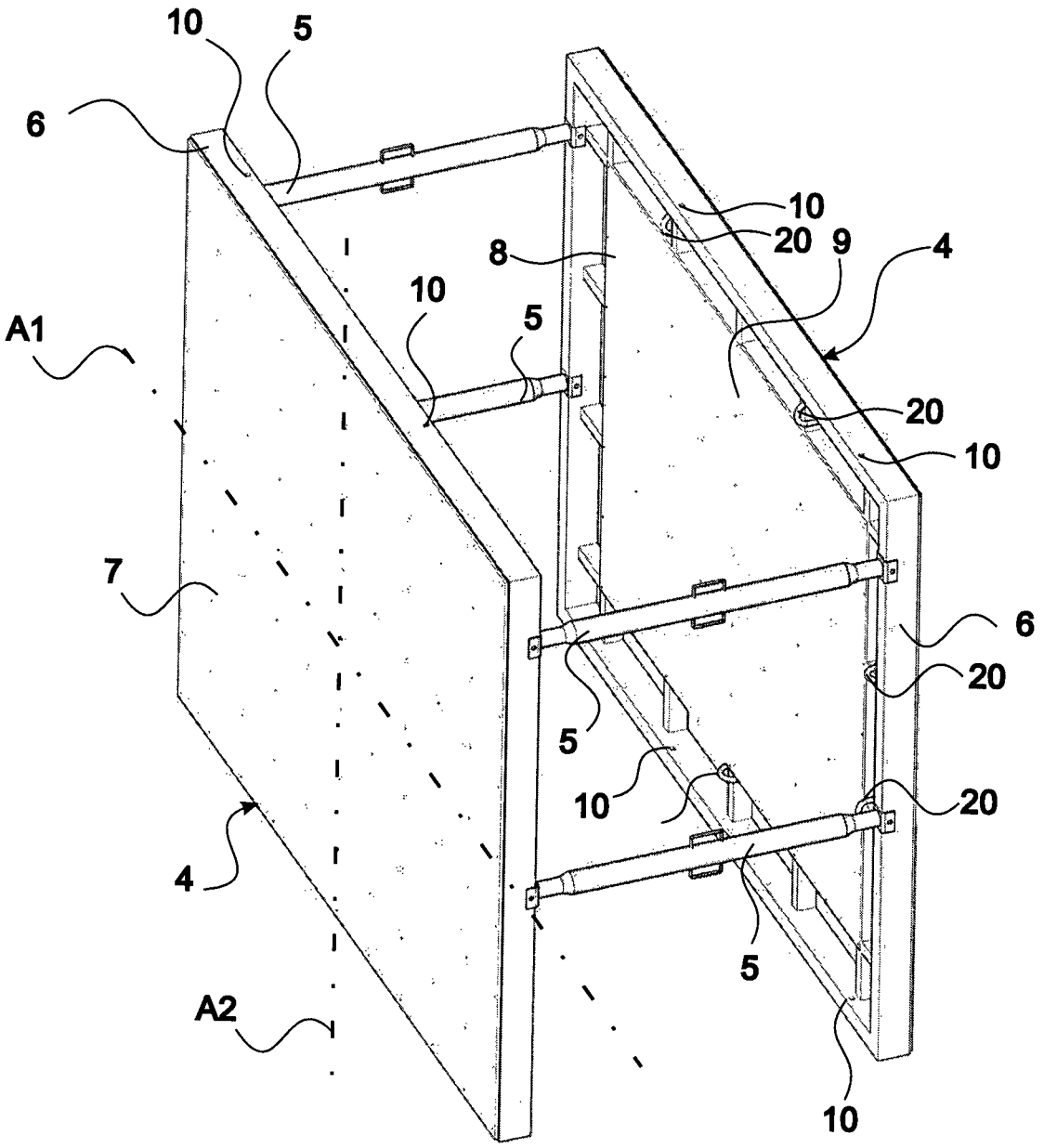
FIG. 6 shows a perspective view of a trench box.

FIG. 6 shows an assembled trench box 1, wherein the two side walls 4 are kept at a distance from the distance struts 5. The distance struts 5 may have various shapes. In this case they are shaped as rigging screws. The two axes A1 and A2 are marked on one side wall 4 and thus it is shown that the trench box shown in FIG. 6 will have the longitudinal axis A1 towards the bottom of a trench. The holes 10 makes turning of the trench box possible, so that instead the axis A2 faces towards the bottom of the trench. If the trench box 1 is turned, the alternative holes 10 will be used for mounting of the distance struts 5. The area of the trench box 1 along the axes A1 and A2 may be produced according to measurements. However, a side wall 4 measures typically between 1.5 and 3.5 meters on one side and 1.5-3.5 meters on the other side.

Figure 7:
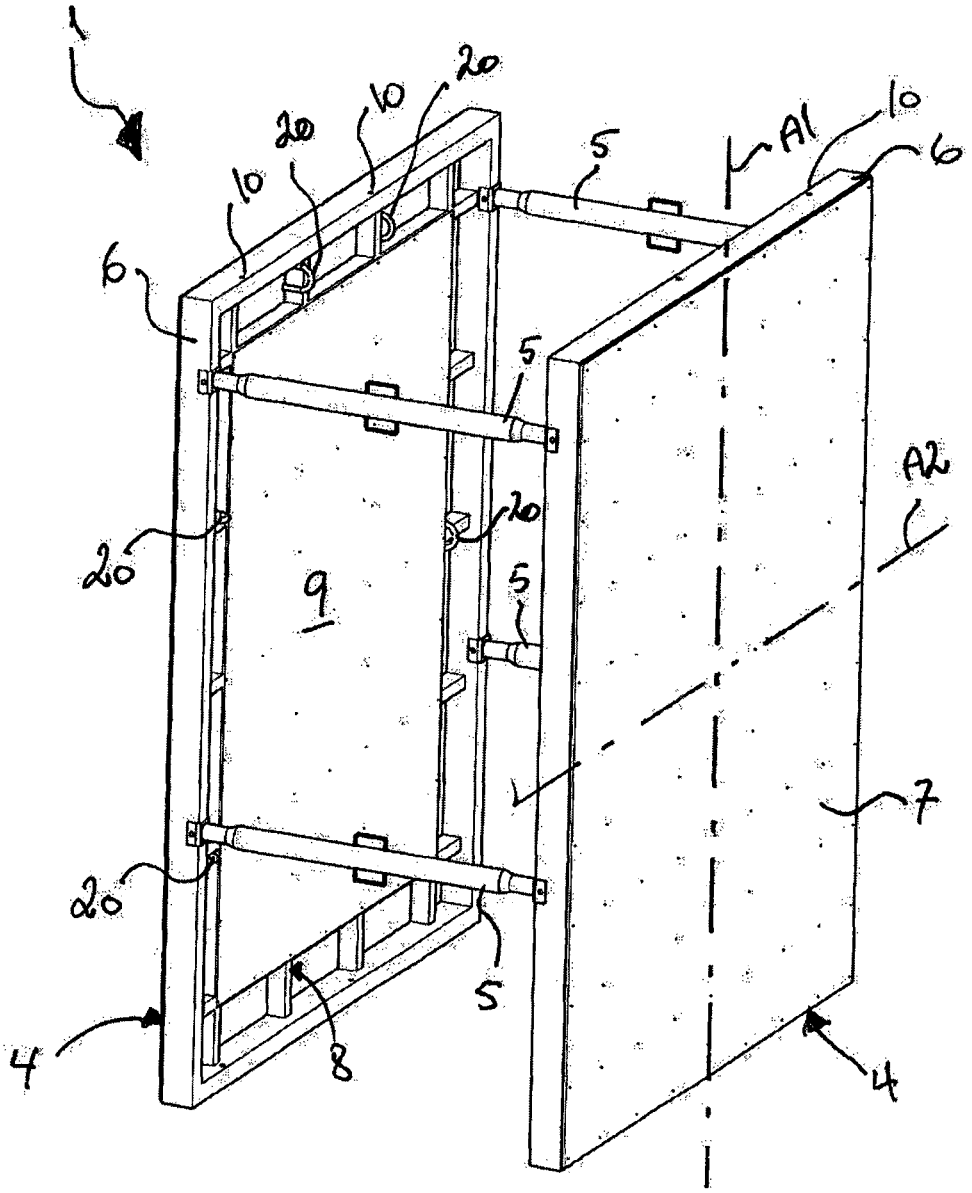
FIG. 7 shows a perspective view of a trench box as shown in FIG. 5, but turned 90°.

FIG. 7 shows a trench box 1 oriented in such way that the bottom of the trench will be substantially parallel with the axis A2. This means that this trench box 1 is oriented such that a height of the side walls 4 extending at a length along the axis A2 is achieved, said length being shorter than the height of the sides along the axis A1. Having this orientation in relation to the axes A1 and A2 makes said trench box 1 aimed at being lowered into a deep pit or deep trench. It should be noted that during transportation and handling of the trench box 1 in this position, other lifting eyes 20 will be used than with another orientation of the trench box 1, e.g. as in FIG. 6. When the trench box 1 is turned from having the axis A1 parallel with the bottom of the trench to having the axis A2 parallel with the bottom of the trench, the distance struts 5 are moved. This is done to achieve strength at the most optimal places of the frame 6. Furthermore, the distance struts 5 are moved, typically because there must be work space below the distance struts 5 and easy access to enter in between the side walls 4. A typical work height may be 70-100 cm below the distance struts. It is easy to move the distance struts 5 as a number of holes 10 is arranged to receive the distance struts in two different positions on each of the four welded parts, i.e. profile elements, of the frame part 6.

The invention claimed is:

1. A trench box comprising:

a plurality of oppositely placed side walls including first and second side walls, each of the first and second side walls having an outer wall area and an inner wall area; and a plurality of distance struts arranged to be secured between said oppositely placed first and second side walls, wherein each one of the first and second side walls comprises at least a frame part, the frame part having a first thickness, a length and a height, the length and the height of the first side wall being substantially the same as the length and height of the second side wall, each of said first and second side walls further comprising a center part placed inside the frame part, said center part having a second thickness and comprising one or more strengthening elements, and each of said first and second side walls further comprising a cover at the outer wall area of the side wall, said cover comprising at least one plate, wherein the at least one plate is substantially planar and without corrugations, wherein the second thickness is less than the first thickness by a thickness difference, the thickness difference resulting in a reduced weight of the trench box.

2. The trench box of claim 1, wherein:

at least the frame part is made of tube elements, each of the tube elements having a closed, tubular shape; and the frame part and the center part are arranged in such a relation to each other that the frame and center parts are substantially level with each other at one side of one of the first and second side walls.

3. The trench box of claim 2, wherein the frame part defines a plurality of through-holes configured to secure a bracket part of a distance strut to the frame part, wherein the through-holes are defined by a through-going tube part extending all the way through one of the tube elements of the frame part.

4. The trench box of claim 1, wherein each one of the first and second side walls comprises an exterior surface and an interior surface;

each one of the covers comprises an outer cover, each one of the outer covers being configured to be attached to one of the exterior surfaces;

the center part of each one of the first and second side walls comprises a central region and a perimeter region surrounding the central region;

the trench box comprises a plurality of inner covers, each one of the inner covers configured to be attached to one of interior surfaces so that the inner cover covers the central region of one of the center parts without covering the perimeter region of the center part so as to facilitate access to the distance struts; and wherein the access facilitates mounting of the distance struts to the first and second side walls.

5. The trench box of claim 1, wherein the cover comprises an outer cover, the trench box further comprising an inner cover arranged at the inner area of one of the first and second side walls on one of the center parts and at a distance from a periphery of the frame part supporting the center part, said inner cover comprising at least one plate.

6. The trench box of claim 1, wherein the frame part comprises a plurality of through-holes for securing a bracket part of a distance strut to the frame part, the distance strut having an adjustable length, and the bracket part having a fork-shape.

7. The trench box of claim 4, wherein each one of the frame parts has a plurality of edges, a plurality of the through holes being arranged at all of the edges of the frame part, both length-wise edges and width-wise edges.

8. The trench box of claim 6, which includes a manually operable bolt configured to secure the distance struts to the frame part on one of the first and second side walls, said bolt comprising a fastener.

9. A method of using the trench box of claim 1, the method comprising:

lowering the first and second side walls into a trench, wherein the trench having has a depth of up to approximately 250 cm; and using the trench box to perform sewage work at an area associated with one or more types of houses.

10. The method of claim 9, wherein the method comprises at least the following steps:

mounting of the distance struts between the first and second side walls;

lowering of the first and second side walls into the trench through use of one of a mini digger or an excavator;

optionally adjusting lengths of the distance struts;

execution of necessary work in the trench;

removal of the trench box from the trench through use of one of the mini digger or the excavator; and separation of the first and second side walls from the distance struts.

11. A trench box comprising:

a plurality of side walls; and a plurality of struts configured to connect the side walls together while maintaining a distance between the side walls, each of the side walls comprising:

a frame having a perimeter wall, the perimeter wall having a perimeter wall thickness;

a support structure bound by the perimeter wall, the support structure having a grid shape, the support structure having a support structure thickness, the support structure thickness being less than the perimeter wall thickness;

an inner cover coupled to the support structure, the inner cover being configured to cover part, but not all, of the support structure; and an outer cover coupled to the perimeter wall, the outer cover configured to cover all of the support structure, the outer cover being flat.

12. The trench box of claim 11, wherein, for each of the side walls, the support structure thickness is less than the perimeter wall thickness by a difference, the difference being great enough to reduce a weight of each one of the side walls to facilitate lifting of the side walls and lowering of the side walls into a trench.

13. The trench box of claim 11, wherein, for each of the side walls, the frame comprises:

a first inner face directed along a thickness axis to face toward the other side wall;

a first outer face directed along the thickness axis to face toward the outer cover;

a second inner face directed along a length axis; and a second outer face directed along the length axis, wherein the second inner face is uncovered by the inner cover.

14. The trench box of claim 13, wherein each one of the struts comprises a plurality of strut ends, each one of the strut ends configured to be mounted to the second inner face.

15. The trench box of claim 14, wherein:

the first inner face is uncovered by the inner cover; and each of the strut ends comprises:

an inner face engager configured to engage the second inner face; and an outer face engager configured to engage the second outer face.

16. A trench box comprising:

a plurality of side walls; and a plurality of struts configured to connect the side walls together while maintaining a distance between the side walls, each one of the struts comprising a strut end configured to be mounted to one of the side walls, each of the side walls comprising:

an exterior surface;

an interior surface;

a frame comprising a perimeter portion, the perimeter portion comprising a perimeter portion thickness and a plurality of strut mount areas;

a support structure bound by the perimeter portion, the support structure having a grid shape, the support structure comprising a support structure thickness, the support structure thickness being less than the perimeter portion thickness;

an outer cover configured to be coupled to the perimeter portion, the outer cover configured to cover the support structure; and an inner cover configured to be coupled to the interior surface, the inner cover being configured to cover part, but not all, of the support structure so that, when the inner cover is coupled to the interior surface, access is provided to the strut mount areas.

17. The trench box of claim 16, wherein, for each of the side walls, the support structure thickness is less than the perimeter portion thickness by a difference, the difference being great enough to reduce a weight of each one of the side walls to facilitate lifting of the side walls and lowering of the side walls into a trench.

18. The trench box of claim 16, wherein, for each of the side walls, the frame comprises:

a first inner face directed along a thickness axis to face toward the other side wall;

a first outer face directed along the thickness axis to face toward the outer cover;

a second inner face directed along a length axis; and a second outer face directed along the length axis, wherein the second inner face is uncovered by the inner cover.

19. The trench box of claim 18, wherein each one of the strut ends is configured to be mounted to the second inner face.

20. The trench box of claim 18, wherein each one of the strut ends comprises:

an inner face engager configured to engage the second inner face; and an outer face engager configured to engage the second outer face.

* * * * *